US010622789B2

(12) United States Patent
Yagi

(10) Patent No.: US 10,622,789 B2
(45) Date of Patent: Apr. 14, 2020

(54) SPARK PLUG

(71) Applicant: NGK SPARK PLUG CO., LTD., Nagoya-shi, Aichi (JP)

(72) Inventor: Ryoki Yagi, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 16/445,319

(22) Filed: Jun. 19, 2019

(65) Prior Publication Data

US 2019/0393682 A1 Dec. 26, 2019

(30) Foreign Application Priority Data

Jun. 22, 2018 (JP) ..... 2018-118417

(51) Int. Cl.
*H01T 13/08* (2006.01)

(52) U.S. Cl.
CPC ..... *H01T 13/08* (2013.01)

(58) Field of Classification Search
None
See application file for complete search history.

(56) References Cited

U.S. PATENT DOCUMENTS 5,263,886 A * 11/1993 Workman ..... H01T 21/02 148/577
2003/0168955 A1* 9/2003 Suzuki ..... H01T 13/36 313/143
2007/0210688 A1* 9/2007 Suzuki ..... H01T 13/20 313/141
2013/0293088 A1* 11/2013 Kuno ..... C22C 19/03 313/141
2013/0334954 A1* 12/2013 Moritani ..... H01T 13/20 313/143
2015/0171598 A1* 6/2015 Suzuki ..... F02P 13/00 277/650
2015/0340842 A1* 11/2015 Ozeki ..... H01T 13/08 313/143

FOREIGN PATENT DOCUMENTS

JP 2007-280942 A 10/2007

* cited by examiner

*Primary Examiner* — Donald L Raleigh
(74) *Attorney, Agent, or Firm* — Kusner & Jaffe

(57) ABSTRACT

A spark plug includes a metallic shell having a cylindrical trunk portion with a male screw formed on its outer circumferential surface and a seat portion located adjacent to the rear end of the trunk portion and projecting radially outward. The trunk portion has a first region and a second region. The first region extends, in the direction of the axial line, at least over a range extending from the rear end of the trunk portion to a first screw thread portion of the male screw as counted from the rear end of the male screw. The second region is located adjacent to the first region in the circumferential direction. The first region has a Vickers hardness higher than that of the second region.

9 Claims, 4 Drawing Sheets

SPARK PLUG

FIELD OF THE INVENTION

The present invention relates to a spark plug, particularly, to a spark plug which includes a metallic shell having a male screw formed on a portion of its outer circumferential surface.

BACKGROUND OF THE INVENTION

A spark plug is attached to an engine by screwing a male screw of a metallic shell of the spark plug into a threaded hole of the engine. Japanese Patent Application Laid-Open (kokai) No. 2007-280942 discloses a technique of preventing breakage of the metallic shell due to application of excessively large tightening torque. According to the disclosed technique, after formation of a male screw on a tubular member which is to become the metallic shell, the tubular member is carburized or quenched, so that the screw portion of the metallic shell is hardened over the entire circumference thereof.

The above-described conventional technique can increase the breaking load of the metallic shell through hardening of the screw portion. However, since the hardened screw portion has lowered toughness, when the speed of tightening (screwing) is high, the metallic shell may break with a load smaller than the breaking load in the case where the tightening speed is low.

SUMMARY OF THE INVENTION

The present invention has been accomplished so as to address the above-described problem. An advantage of the invention is a spark plug which can prevent breakage of its metallic shell irrespective of tightening speed.

In accordance with a first aspect of the present invention there is provided a spark plug comprised of a metallic shell including a cylindrical trunk portion extending along an axial line from a forward end side toward a rear end side and having a male screw formed on an outer circumferential surface thereof, and a seat portion located adjacent to a rear end of the trunk portion and projecting radially outward. The trunk portion has a first region and a second region. The first region extends, in the direction of the axial line, at least over a range extending from a rear end of the trunk portion to a first screw thread portion of the male screw as counted from a rear end of the male screw, and extends partially in a circumferential direction of the trunk portion. The second region is located adjacent to the first region in the circumferential direction. The first region has a Vickers hardness higher than that of the second region.

In accordance with a second aspect of the present invention there is provided a spark plug comprised of a metallic shell including a cylindrical trunk portion extending along an axial line from a forward end side toward a rear end side and having a male screw formed on an outer circumferential surface thereof, and a seat portion located adjacent to a rear end of the trunk portion and projecting radially outward. The trunk portion has a first region and a second region. The first region extends, in the direction of the axial line, at least over a range extending from a rear end of the trunk portion to a first screw thread portion of the male screw as counted from a rear end of the male screw, and extends partially in a circumferential direction of the trunk portion. The second region is located adjacent to the first region in the circumferential direction. The first region and the second region have different structures, and martensite is present in the first region.

According to a third aspect of the present invention there is provided a spark plug as described above wherein, the first region and the second region located adjacent to the first region in the circumferential direction and having a Vickers hardness lower than that of the first region are present in a portion of the trunk portion of the metallic shell to which a large tightening axial force acts when the spark plug is tightened; i.e., a range extending from the rear end of the trunk portion to the first screw thread portion of the male screw as counted from the rear end of the male screw. Since the second region which is lower in Vickers hardness than the first region extends in parallel to the first region along the direction in which the tightening axial force acts, when the male screw is tightened, the tightening axial force is distributed to the first region and the second region such that the amount of elongation of the first region becomes equal to the amount of elongation of the second region. As a result, unlike the case where the second region is not present, the metallic shell is prevented from breaking, when tightened at high speed, with a load smaller than the breaking load in the case where the tightening speed is low. Accordingly, breakage of the metallic shell can be prevented irrespective of tightening speed.

According to a fourth aspect of the present invention there is provided a spark plug as described above wherein, the trunk portion of the metallic shell has a first region which extends over the range extending from the rear end of the trunk portion to the first screw thread portion of the male screw as counted from the rear end of the male screw, and a second region located adjacent to the first region in the circumferential direction. The first region and the second region have different structures, and martensite which is high in hardness is not present in the second region. Since the second region softer than the first region extends in parallel to the first region along the direction in which the tightening axial force acts, an effect similar to the effect described above with respect to the third aspect of the invention is yielded.

According to a fifth aspect of the present invention there is provided a spark plug as described above wherein, the second region is disposed on each of opposite sides of the first region in the circumferential direction such that the second region is located adjacent to the first region. Therefore, in addition to the effect of the third and fourth aspect of the invention, there is yielded an effect of more reliably preventing breakage of the metallic shell irrespective of tightening speed.

According to a sixth aspect of the present invention there is provided a spark plug as described above wherein, martensite is present in the first region. Therefore, in addition to the effect of the third aspect of the invention, there is yielded an effect of allowing production of the metallic shell from carbon steel.

According to a seventh aspect of the present invention there is provided a spark plug as described above wherein, the first region extends, in the direction of the axial line, from the rear end of the trunk portion to the forward end of the male screw. Therefore, in addition to the effect of any of the third through sixth aspect of the invention, there is yielded an effect of increasing strength in the region which extends from the rear end of the trunk portion to the forward end of the male screw and on which tightening axial force acts.

DETAILED DESCRIPTION OF THE INVENTION

Figure 1:
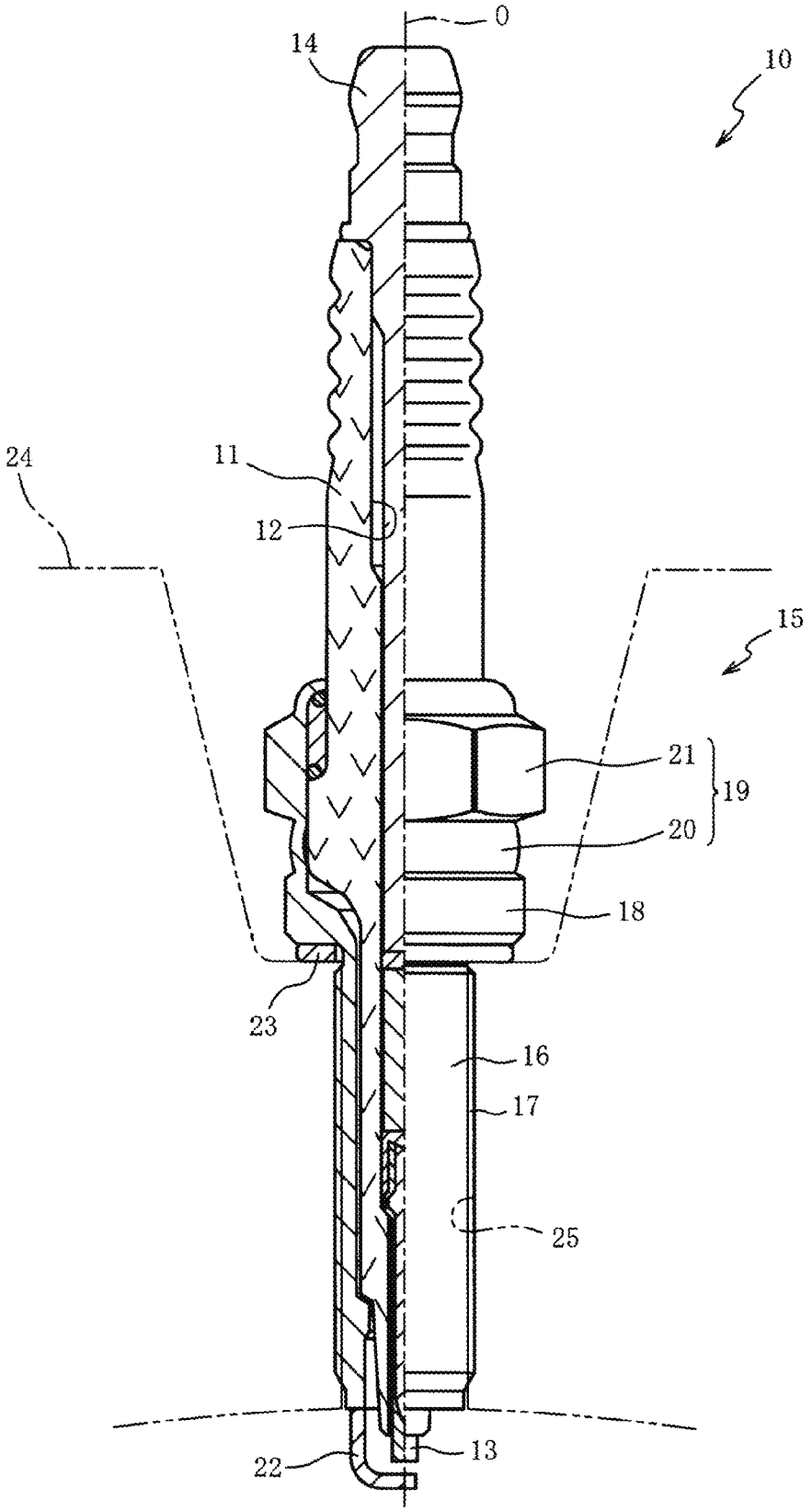
FIG. 1 is a half sectional view of a spark plug according to a first embodiment.

Preferred embodiments of the present invention will next be described with reference to the appended drawings. FIG. 1 is a half sectional view, bordered with an axial line O, of a spark plug 10 according to a first embodiment. In FIG. 1, the screw tread of a male screw 17 is shown in a simplified manner (this also applies to FIG. 2A and FIGS. 4A to 4C). The lower side of FIG. 1 is called the forward end side of the spark plug 10, and the upper side of FIG. 1 is called the rear end side of the spark plug 10.

As shown in FIG. 1, the spark plug 10 has a metallic shell 15 holding an insulator 11. The insulator 11 is an approximately cylindrical member formed of, for example, alumina which is excellent in mechanical characteristics and insulating performance at high temperature. The insulator 11 has an axial hole 12 extending therethrough along the axial line O.

A center electrode 13 is a rod-shaped electrode which is inserted into the axial hole 12 and held by the insulator 11 to extend along the axial line O. The center electrode 13 is disposed in the axial hole 12 such that the center electrode 13 projects from the forward end of the insulator 11. The center electrode 13 is configured such that a core excellent in thermal conductivity is embedded in an electrode base member. The electrode base member is formed of a metal material made of Ni or an alloy containing Ni as a main component. The core is formed of copper or an alloy containing copper as a main component. The core may be omitted.

A metal terminal 14 is a rod-shaped member to which a high-voltage cable (not shown) is connected. A portion of the metal terminal 14 on the forward end side is disposed in the insulator 11. The metal terminal 14 is electrically connected to the center electrode 13 within the axial hole 12. The metallic shell 15 is fixed to a portion of the outer circumference of the insulator 11 on the forward end side.

The metallic shell 15 is an approximately cylindrical member formed of an electrically conductive metal material (e.g., low-carbon steel). The metallic shell 15 includes a cylindrical trunk portion 16, a seat portion 18 located adjacent to the rear end of the trunk portion 16 and projecting radially outward, and a rear end portion 19 located adjacent to the rear end of the seat portion 18. The rear end portion 19 includes a thin wall portion 20 which is smaller in wall thickness than the seat portion 18, and a tool engagement portion 21 projecting radially outward from the thin wall portion 20.

The trunk portion 16 is a portion surrounding a portion of the insulator 11 on the forward end side and has a male screw 17 formed on the outer circumference thereof. The male screw 17 comes into a screw engagement with a threaded hole 25 of an engine 24, thereby fixing the metallic shell 15 to the engine 24. The seat portion 18 limits the amount of screwing of male screw 17 into the engine 24 and closes the gap between the male screw 17 and the wall surface of the threaded hole 25. In the present embodiment, a gasket 23 is attached to the forward end of the seat portion 18. The gasket 23 sandwiched between the seat portion 18 and the engine 24 seals the gap between the male screw 17 and the wall surface of the threaded hole 25.

The thin wall portion 20 is a portion which is plastically deformed and crimped for fixing when the metallic shell 15 is fitted onto the insulator 11. The tool engagement portion 21 is a portion with which a tool such as a wrench is engaged when the male screw 17 is screwed into the threaded hole 25 of the engine 24.

A ground electrode 22 is a rod-shaped member formed of a metal (for example, a nickel alloy) and is joined to the trunk portion 16 of the metallic shell 15. A spark gap is formed between the ground electrode 22 and the center electrode 13. In the present embodiment, the ground electrode 22 is bent.

The spark plug 10 is manufactured by, for example, a method described below. First, the center electrode 13 is inserted into the axial hole 12 of the insulator 11 and is disposed such that the forward end of the center electrode 13 projects from the forward end of the insulator 11. Subsequently, the metal terminal 14 is inserted into the axial hole 12 of the insulator 11 so as to secure electrical continuity between the metal terminal 14 and the center electrode 13. Subsequently, the insulator 11 is inserted into the metallic shell 15 to which the ground electrode 22 has been joined in advance, and the rear end of the metallic shell 15 is bent so as to fix the metallic shell 15 to the insulator 11. The ground electrode 22 is bent, and the gasket 23 is attached, whereby the spark plug 10 is completed.

Figure 2A:
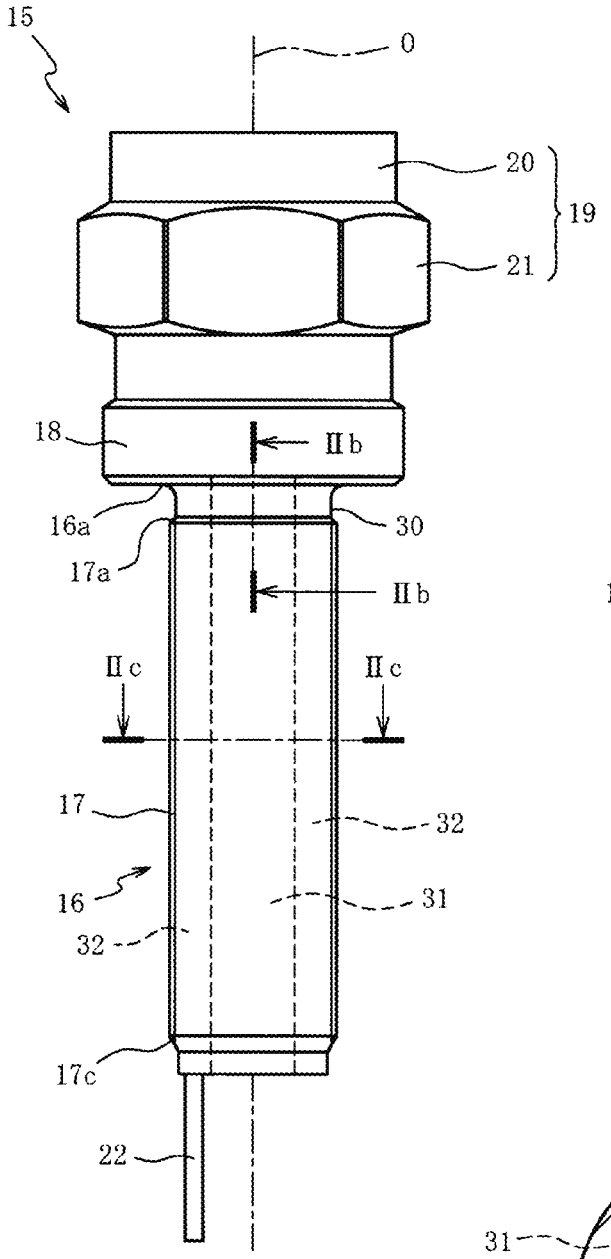
FIG. 2A is a side view of a metallic shell.
Figure 2B:
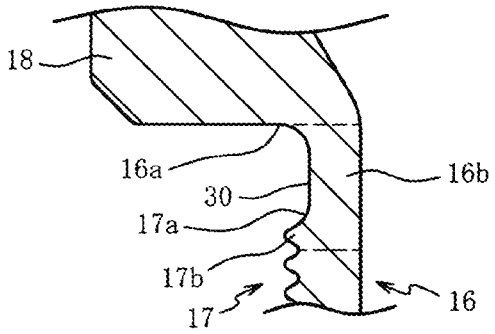
FIG. 2B is a sectional view of the metallic shell taken along line IIb-IIb of FIG. 2A.
Figure 2C:
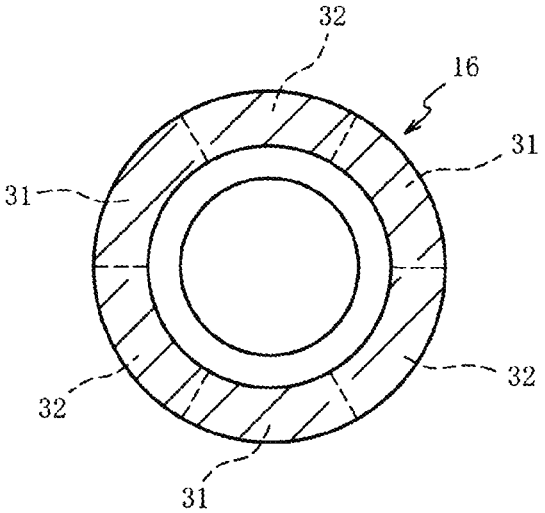
FIG. 2C is a sectional view of the metallic shell taken along line IIc-IIc of FIG. 2A.

The metallic shell 15 will be described with reference to FIGS. 2A to 2C. FIG. 2A is a side view of the metallic shell 15, FIG. 2B is a sectional view of the metallic shell 15 taken along line IIb-IIb of FIG. 2A, and FIG. 2C is a sectional view of the metallic shell 15 taken along line IIc-IIc of FIG. 2A. FIG. 2A shows the metallic shell 15 in a state before being fitted onto the insulator 11. The lower side of FIG. 2A is called the forward end side of the metallic shell 15, and the upper side of FIG. 2A is called the rear end side of the metallic shell 15 (this also applies to FIG. 4A to FIG. 4C).

The metallic shell 15 is manufactured by, for example, a method described below. First, a tubular workpiece (not shown) from which the metallic shell 15 is produced, is formed by means of cold forging, cutting, or the like. In the workpiece, an engagement portion 30 is located adjacent to the forward end of the seat portion 18. The engagement portion 30 is a portion with which the gasket 23 (see FIG. 1) is engaged.

After the ground electrode 22 (a straight electrode before being bent) is joined to the trunk portion 16 of the workpiece as shown in FIG. 2A, the male screw 17 is formed on the trunk portion 16 by means of form rolling, cutting, or the like. The engagement portion 30 is located adjacent to the rear end 17*a* of the male screw 17. As shown in FIG. 2B, the root diameter of the male screw 17 is approximately equal to the outer diameter of the engagement portion 30. After formation of the male screw 17 on the trunk portion 16, first regions 31 and second regions 32 are formed on the trunk portion 16, whereby the metallic shell 15 is obtained. Plating or the like is performed for the metallic shell 15 when necessary.

The Vickers hardness of the first regions 31 is greater than the Vickers hardness of the second regions 32. In the present embodiment, the metallic shell 15 is formed of low carbon steel, and portions of the surface of the male screw 17 are irradiated with a laser beam for heating. As a result, heated portions of the male screw 17 are quenched, whereby the first regions 31 are formed. Regions (portions) which are not heated sufficiently become the second regions 32. When necessary, tempering is performed after the quenching. Due to the quenching, martensite is present in the structure of each first region 31, and at least one of austenite and pearlite is present in the structure of each second region 32. Since the metallic shell 15 formed of carbon steel is used, the first regions 31 and the second regions 32 which differ in hardness can be formed through heat treatment.

Notably, the method of forming the first regions 31 is not limited to laser quenching. Needless to say, the first regions 31 can be formed by means of electron beam quenching, discharge hardening, or shot peening. Since discharge hardening and shot peening do not harden the structure by using solid solution of carbon, the material of the metallic shell 15 is not limited to carbon steel. In this case, the material of the metallic shell can be appropriately selected from various metal materials in consideration of thermal conductivity, heat resistance, etc.

Also, the method of forming the first and second regions 31 and 32 is not limited to the method of forming the first regions 31 by partially hardening the male screw 17. Needless to say, it is possible to form the second regions 32 by partially softening the male screw 17. In this case, remaining portions become the first regions 31. For example, after the metallic shell 15 having the male screw 17 formed thereon is hardened by means of quenching and tempering, portions of the surface of the male screw 17 are irradiated with a laser beam or electron beam for heating so that portions of the male screw 17 are annealed, whereby the second regions 32 are formed. Regions (portions) which are not annealed sufficiently become the first regions 31.

As shown in FIG. 2C, the first regions 31 are portions of the trunk portion 16 which extend partially in the circumferential direction, and the second regions 32 are located adjacent to the first regions 31 in the circumferential direction. The first regions 31 and the second regions 32 are present in a range 16*b* of the trunk portion 16 in which a large tightening axial force acts on the trunk portion 16 when the male screw 17 of the spark plug 10 is screwed into the threaded hole 25 of the engine 24. The range 16*b* extends from the rear end 16*a* (see FIG. 2B) to a first screw thread portion 17*b* of the male screw 17 as counted from the rear end 17*a* of the male screw 17. The first screw thread portion 17*b* may be a complete thread portion or an incomplete thread portion. In the present embodiment, the first regions 31 and the second regions 32 extend from the rear end 16*a* of the trunk portion 16 to the forward end 17*c* of the male screw 17. Two second regions 32 are disposed on opposite sides of each first region 31 in the circumferential direction such that the two second regions 32 are located adjacent to the first region 31. In the present embodiment, the number of the first regions 31 and the number of the second regions 32 are three.

The Vickers hardnesses of the first regions 31 and the second regions 32 are measured by a method prescribed in JIS Z2244: 2009. The trunk portion 16 is cut along a plane perpendicular to the axial line O, and the cut surface is mirror-polished, whereby a test piece for Vickers hardness measurement is obtained. In the Vickers hardness test, an indenting tool is pressed against the test piece (the trunk portion 16) at a plurality of measurement points separated from one another in the circumferential direction, whereby indents are formed. The distances between the outer circumferential surface of the trunk portion 16 to the respective measurement points are the same, and the same test force is applied to the indenting tool for the same period of time at the respective measurement points.

In the present embodiment, the first regions 31 are hardened entirely in the thickness direction (radial direction) of the trunk portion 16 as a result of laser quenching. Therefore, the measurement points are located at the thicknesswise center of the trunk portion 16. However, in the case where the first regions 31 and the second regions 32 are present only in a surface portion of the male screw 17 (for example, the case where the first regions 31 are formed by means of shot peening or the like), the Vickers hardnesses of hardened (or softened) portions are measured.

Since the Vickers hardness varies about ±50 HV among the first regions 31 or among the second regions 32, the first regions 31 and the second regions 32 are formed such that a Vickers hardness difference of 100 HV or greater is present between the first regions 31 and the second regions 32. For example, the Vickers hardnesses of the first regions 31 are 500 HV or greater, and the Vickers hardnesses of the second regions 32 are less than 400 HV.

The first regions 31 and the second regions 32 of the trunk portion 16 which are adjacently located in the circumferential direction can be determined by comparing the Vickers hardnesses measured at the plurality of measurement points separated from one another in the circumferential direction. Further, by measuring the Vickers hardnesses of a plurality of test pieces which differ from one another in the distance between the rear end 16*a* of the trunk portion 16 and the cut surface, the range in which the first regions 31 and the second regions 32 extend from the rear end 16*a* of the trunk portion 16 toward the forward end side can be determined. By combining these measurements, the extensions of the first regions 31 and the second regions 32 in the circumferential and axial directions in the trunk portion 16 can be determined.

Also, the presence of martensite in the first region 31 can be checked as follows. The trunk portion 16 is cut along a plane perpendicular to the axial line O, and the trunk portion 16 is polished such that a flat cross section appears. Through structural observation of a compositional image obtained by a metallurgical microscope or an SEM, the presence of martensite can be checked. When necessary, electrolytic etching, nonelectrolytic etching, or the like is performed using an etching solution before the structural observation. Further, through the structural observation of a plurality of sections which differ from one another in the distance from the rear end 16*a* of the trunk portion 16 thereto, the range in which the first regions 31 and the second regions 32 extend from the rear end 16*a* of the trunk portion 16 toward the forward end side can be determined. By combining these observations, the extensions of the first regions 31 and the second regions 32 in the circumferential and axial directions in the trunk portion 16 can be determined.

Figure 3:
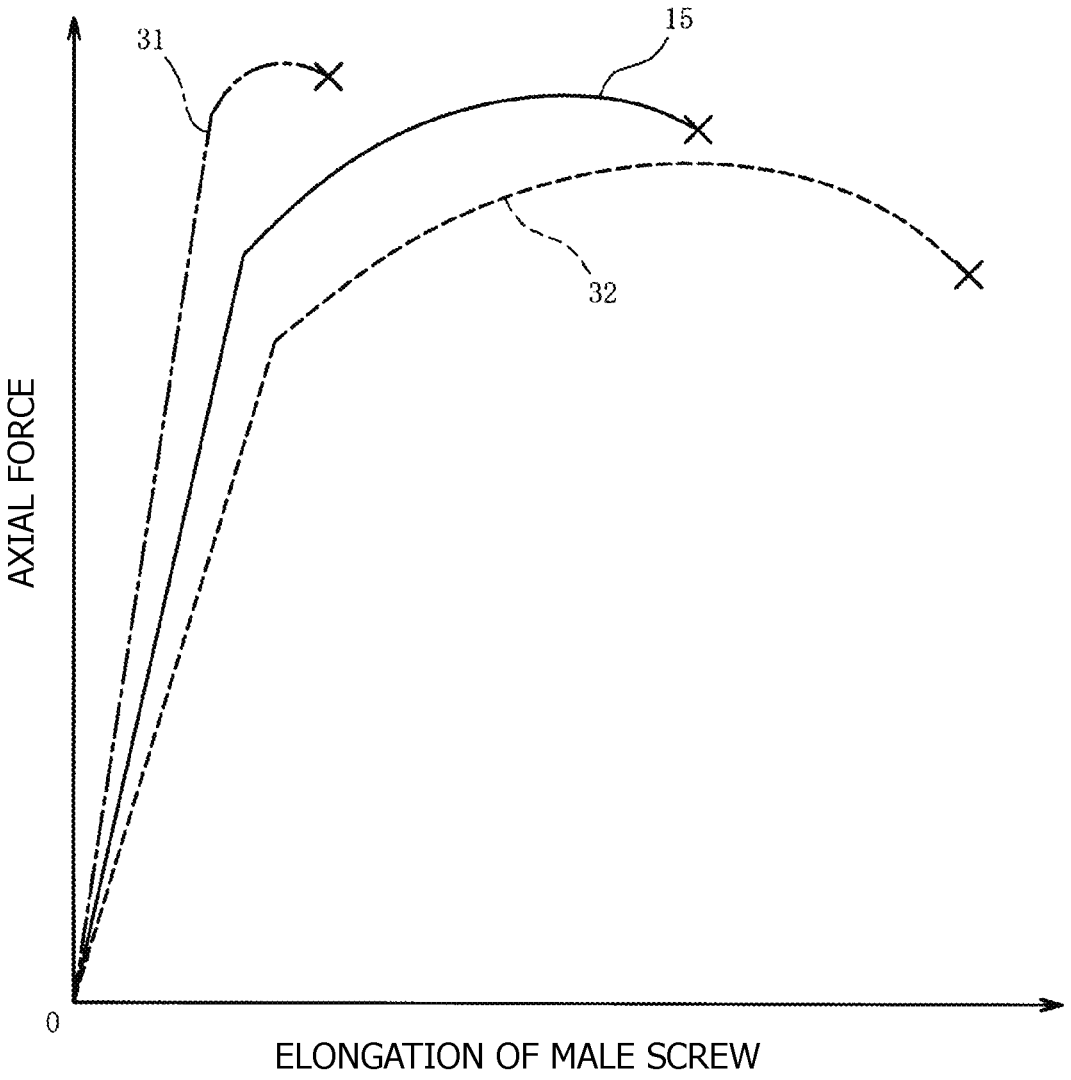
FIG. 3 is a graph showing the relation between tightening axial force and elongation of a male screw of the metallic shell.

FIG. 3 is a graph showing the relation between tightening axial force and elongation of the male screw 17 of the metallic shell 15. FIG. 3 shows not only a curve for the metallic shell 15 of the present embodiment but also a curve for a metallic shell of a comparative example in which the first region 31 is formed over the entire circumference of the male screw 17 (hereinafter referred to as the "metallic shell 31") and a curve for a metallic shell of a comparative example in which the second region 32 is formed over the entire circumference of the male screw 17 (hereinafter referred to as the "metallic shell 32").

When an excessively large tightening torque acts on the male screw 17 of a metallic shell, the stress of the metallic shell exceeds a yield point and the metallic shell breaks. The metallic shell 32 is larger in elongation than the metallic shell 31 but smaller in breaking load than the metallic shell 31. Meanwhile, because of hardening of the male screw 17, the metallic shell 31 is larger in breaking load than the metallic shell 32. However, because of decreased toughness of the male screw 17, the amount of elongation of the metallic shell 31 before breaking is small. Therefore, when the speed of tightening (screwing) is high, due to an impact caused by tightening, the metallic shell 31 may break with a load smaller than the breaking load in the case where the tightening speed is low.

In contrast, in the metallic shell 15, the first regions 31 and the second regions 32 each of which is located adjacent to the corresponding one of the first regions 31 in the circumferential direction and is lower in Vickers hardness than the first regions 31 are present in the range 16*b* extending from the rear end 16*a* of the trunk portion 16 to the first screw thread portion 17*b* of the male screw 17 as counted from the rear end 17*a* of the male screw 17. Stress concentration is likely to occur in the range 16*b* at the time of tightening. Since the second regions 32 extend in parallel to the first regions 31 along the direction (axial direction) in which the tightening axial force acts, when the male screw 17 is tightened, the tightening axial force is distributed to the first regions 31 and the second regions 32 such that the amount of elongation of the first regions 31 becomes equal to the amount of elongation of the second regions 32. As a result, unlike the case where the second regions 32 are not present (the case of the metallic shell 31), the metallic shell 15 is prevented from breaking, when tightened at high speed, with a load smaller than the breaking load in the case where the tightening speed is low. Accordingly, breakage of the metallic shell can be prevented irrespective of tightening speed.

Also, in the metallic shell 15, the first regions 31 are hardened and contain martensite. The first regions 31 differ in structure from the second regions 32, and martensite is not present in the second regions 32. Since the second regions 32 softer than the first regions 31 extend in parallel to the first region 31 along the direction in which the tightening axial force acts, as described above, breakage of the metallic shell can be prevented irrespective of tightening speed.

Since two second regions 32 are present on opposite sides of each first region 31 in the circumferential direction, the second regions 32 softer than the first regions 31 can be dispersed in the circumferential direction. By virtue of this, breakage of the metallic shell 15 can be prevented more reliably irrespective of tightening speed.

Also, since the first regions 31 extend in the axial direction over a range extending from the rear end 16*a* of the trunk portion 16 to the forward end 17*c* of the male screw 17, the strength of the trunk portion 16 can be increased not only in the range 16*b* which extends from the rear end 16*a* to the first screw thread portion 17*b* and in which stress concentration is likely to occur but also the region which extends from the rear end 16*a* of the trunk portion 16 to the forward end 17*c* of the male screw 17 and on which the tightening axial force is applied.

Figure 4A:
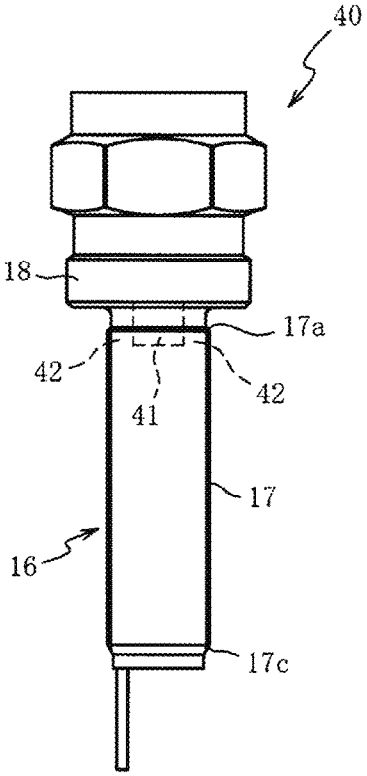
FIG. 4A is a side view of a metallic shell of a spark plug according to a second embodiment.
Figure 4B:
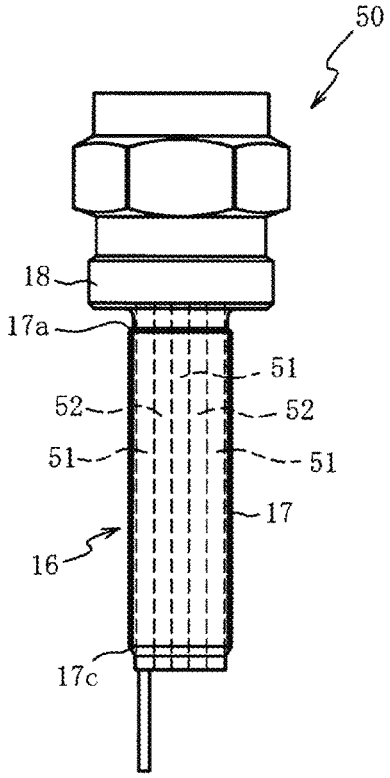
FIG. 4B is a side view of a metallic shell of a spark plug according to a third embodiment.
Figure 4C:
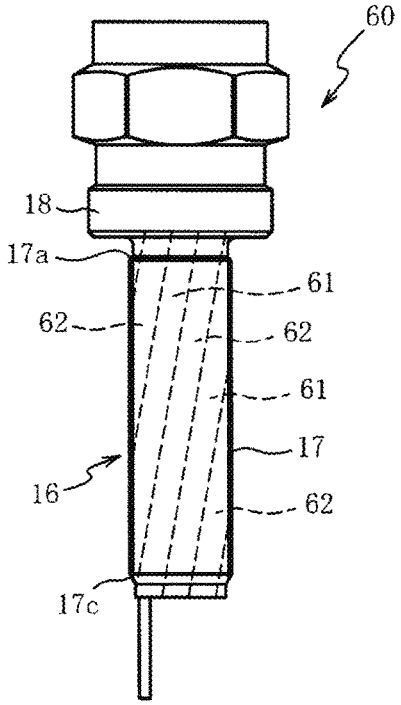
FIG. 4C is a side view of a metallic shell of a spark plug according to a fourth embodiment.

Second through fourth embodiments will be described with reference to FIG. 4A, FIG. 4B, and FIG. 4C. FIG. 4A is a side view of a metallic shell 40 of a spark plug according to a second embodiment, FIG. 4B is a side view of a metallic shell 50 of a spark plug according to a third embodiment, and FIG. 4C is a side view of a metallic shell 60 of a spark plug according to a fourth embodiment. The metallic shells 40, 50, and 60 support the insulator 11 in stead of the metallic shell 15 of the spark plug 10 of the first embodiment. Portions identical with those of the metallic shell of the first embodiment are denoted by the same reference numerals and will not be described redundantly.

As shown in FIG. 4A, in the metallic shell 40, two first regions 41 and one second region 42 are formed alternatingly in the circumferential direction of the trunk portion 16. The first regions 41 are greater in Vickers hardness than the second region 42, and martensite is present in the structure of each first region 41.

The first regions 41 are present in the range 16*b* extending from the rear end 16*a* of the trunk portion 16 to the first screw thread portion 17*b* (see FIG. 2B). The second region 42 is present, in the axial direction (the vertical direction in FIG. 4A), over a range extending from the forward ends of the first regions 41 to the forward end 17*c* of the male screw 17. In the present embodiment, the two first regions 41 are present in the range 16*b* and two upper end portions of the second region 42 are present in the range 16*b*. Since the metallic shell 40 has the first regions 41 and the second region 42 present in the range 16*b* in which stress concentration is likely to occur, as described for the first embodiment, breakage of the metallic shell 40 can be prevented irrespective of tightening speed.

As shown in FIG. 4B, in the metallic shell 50, first regions 51 and second regions 52 are formed alternatingly in the circumferential direction of the trunk portion 16. The first regions 51 are greater in Vickers hardness than the second regions 52, and martensite is present in the structure of each first region 51.

The first regions 51 are present in a range extending from the rear end 16*a* of the trunk portion 16 to the forward end 17*c* of the male screw 17. In the present embodiment, the number of the first regions 51 is six, and the number of the second regions 52 is six. Since the widths of the first regions 51 and the second regions 52 in the circumferential direction can be made smaller as compared with the first embodiment, the treating area of the male screw 17 for forming the first regions 51 and the second regions 52 can be reduced. As a result, the metallic shell 50 yields not only the action and effect described in the first embodiment but also an effect of simplifying the process of forming the first regions 51 and the second regions 52.

As shown in FIG. 4C, in the metallic shell 60, first regions 61 and second regions 62 are formed alternatingly in the circumferential direction of the trunk portion 16. The first regions 61 are greater in Vickers hardness than the second regions 62, and martensite is present in the structure of each first region 61.

The first regions 61 and the second regions 62 are formed such that they extend spirally from the rear end 16*a* of the trunk portion 16. As a result, the first regions 61 and the second regions 62 can have longer lengths as compared with the case where the first regions and the second regions extend parallel to the axial line O (see FIG. 2A). Since the amounts of elongations of the first regions 61 and the second regions 62 can be respectively increased by the amounts by which the lengths of the first regions 61 and the second regions 62 are increased, respectively, the metallic shell 60 yields not only the action and effect described in the first embodiment but also an effect of expanding an allowable range of tightening torque.

The present invention has been described on the basis of embodiments. However, it can be guessed that the present invention is not limited to the above-described embodiments and can be improved and modified without departing from the spirit of the present invention. For example, the number of the first regions 31 (41, 51, 61) and the number of the second regions 32 (42, 52, 62) may be set appropriately so long as at least one first region and at least one second region are present.

In the embodiments, the spark plug 10 has the gasket 23 disposed on the forward end of the seat portion 18 of the metallic shell 15 (40, 50, 60). However, the present invention is not limited to the spark plug 10 having the gasket 23. Needless to say, the present invention can be applied to a taper-seat-type spark plug (metallic shell) which includes no gasket and in which the forward end surface of the seat portion 18 is tapered and the seat portion 18 is brought into contact with the engine 24, thereby sealing combustion gas.

In the embodiments, the first regions 31 (41, 51, 61) are formed by means of quenching, discharge hardening, or shot peening, and the second regions 32 (42, 52, 62) are formed by means of annealing. However, the method of forming the first regions and the second regions are not limited thereto. Needless to say, it is possible to manufacture a metallic shell including the first regions and the second regions by preparing two materials whose Vickers hardnesses differ from each other by 100 HV or more, forming the first regions and the second regions by using the two materials, and joining them together by means of welding or the like.

DESCRIPTION OF REFERENCE NUMERALS

10: spark plug
15, 40, 50, 60: metallic shell
16: trunk portion
16*a:* trunk portion rear end
16*b:* range
17: male screw
17*a:* male screw rear end
17*b:* screw thread
17*c:* male screw forward end
18: seat portion
31, 41, 51, 61: first region
32, 42, 52, 62: second region
O: axial line Having described the invention, the following is claimed:

1. A spark plug comprising a metallic shell including:

a cylindrical trunk portion extending along an axial line from a forward end side toward a rear end side and having a male screw formed on an outer circumferential surface thereof, and a seat portion located adjacent to a rear end of the trunk portion and projecting radially outward, wherein the trunk portion has:

a first region which extends, in the direction of the axial line, at least over a range extending from a rear end of the trunk portion to a first screw thread portion of the male screw as counted from a rear end of the male screw and which extends partially in a circumferential direction of the trunk portion, and a second region located adjacent to the first region in the circumferential direction, and wherein the first region has a Vickers hardness higher than that of the second region.

2. A spark plug comprising a metallic shell including:

a cylindrical trunk portion extending along an axial line from a forward end side toward a rear end side and having a male screw formed on an outer circumferential surface thereof, and a seat portion located adjacent to a rear end of the trunk portion and projecting radially outward, wherein the trunk portion has:

a first region which extends, in the direction of the axial line, at least over a range extending from a rear end of the trunk portion to a first screw thread portion of the male screw as counted from a rear end of the male screw and which extends partially in a circumferential direction of the trunk portion, and a second region located adjacent to the first region in the circumferential direction, and wherein the first region and the second region have different structures, and martensite is present in the first region.

3. A spark plug according to claim 1, wherein the second region is disposed on each of opposite sides of the first region in the circumferential direction such that the second region is located adjacent to the first region.

4. A spark plug according to claim 2, wherein the second region is disposed on each of opposite sides of the first region in the circumferential direction such that the second region is located adjacent to the first region.

5. A spark plug according to claim 1, wherein martensite is present in the first region.

6. A spark plug according to claim 1, wherein the first region extends, in the direction of the axial line, from the rear end of the trunk portion to a forward end of the male screw.

7. A spark plug according to claim 2, wherein the first region extends, in the direction of the axial line, from the rear end of the trunk portion to a forward end of the male screw.

8. A spark plug according to claim 3, wherein the first region extends, in the direction of the axial line, from the rear end of the trunk portion to a forward end of the male screw.

9. A spark plug according to claim 4, wherein the first region extends, in the direction of the axial line, from the rear end of the trunk portion to a forward end of the male screw.

* * * * *